United States Patent [19]

Kern et al.

[11] 4,356,802

[45] Nov. 2, 1982

[54] VALVE SYSTEM FOR REGULATING THE IDLING SPEED OF OTTO ENGINES, PARTICULARLY AUTOMOBILE ENGINES

[75] Inventors: Eckhart Kern, Hofheim; Harald Collonia, Glashütten; Herbert-Hans Groh, Frankfurt am Main, all of Fed. Rep. of Germany

[73] Assignee: VDO Adolf Schindling AG, Frankfurt am Main, Fed. Rep. of Germany

[21] Appl. No.: 215,898

[22] Filed: Dec. 12, 1980

[30] Foreign Application Priority Data

Dec. 12, 1979 [DE] Fed. Rep. of Germany ..... 2949884

[51] Int. Cl.[3] ..... F02D 31/00

[52] U.S. Cl. ..... 123/339; 123/352; 123/585

[58] Field of Search ..... 123/339, 352, 353, 354, 123/355, 361, 585; 180/178, 179

[56] References Cited

U.S. PATENT DOCUMENTS

| | | | |
|---|---|---|---|
| 3,661,131 | 5/1972 | Croft | 123/339 |
| 3,780,718 | 12/1973 | Nambu et al. | 123/438 X |
| 4,132,194 | 1/1979 | Saito | 123/589 X |
| 4,306,527 | 12/1981 | Kinugawa et al. | 123/352 X |

*Primary Examiner*—Tony M. Argenbright

*Attorney, Agent, or Firm*—Martin A. Farber

[57] ABSTRACT

A valve system for regulating the idling speed of Otto engines, particularly automobile engines, by controlling the amount of air on an outlet side with an electromechanical setting member which comprises a valve element which limits the effective outlet cross section, the valve element being moveable by an electric drive member and being in communication on one side with the outlet side, and having a circuit which controls the setting member as a function of the speed of rotation. The valve element is mounted substantially free of friction and means are provided for exerting on the valve element a compensating force which opposes the force caused by the suction vacuum.

9 Claims, 4 Drawing Figures

VALVE SYSTEM FOR REGULATING THE IDLING SPEED OF OTTO ENGINES, PARTICULARLY AUTOMOBILE ENGINES

The present invention relates to a valve system for regulating the idling speed of Otto engines particularly automobile engines, by controlling the amount of air at the outlet side, by an electromechanical setting member which comprises a valve element which limits the effective outlet cross section, is movable by an electric drive member and is in communication on one side with said outlet side, and having a circuit which controls the setting member as a function of the speed of rotation.

Such known valve systems for regulating the idling speed are used in order to set the slowest possible speed or rotation, particularly in automotive vehicles, this resulting in favorable consumption and emission values. If the lowest possible idling speed is desired, the air flow through the carburetor which is necessary for this cannot be predetermined once and for all since the idling speed may be subject to variations even when the Otto engine is operated with a constant charge. Such variations may be caused by different conditions of load upon idling, as in the cold running phase, or by the power requirement of an air conditioning system, a hydraulic system having a pump driven by the engine, or the like. In addition to this, at low idling speed the condition of operation of an Otto engine is close to the unstable speed range at which the engine can die in case of further additional load.

For this reason there is already known a valve system for regulating the idling speed which has a servomotor which is fed from a difference amplifier. One input of the difference amplifier is acted on by an electric value which corresponds to the desired idling speed. A second input of the difference amplifier is connected to a tachometer. By this difference amplifier the servomotor is accordingly acted on by an electric variable which corresponds to the difference between the actual idling speed and the desired speed. Thus, the servomotor attempts so to displace a valve element in the valve system that the amount of air necessary for the desired idling speed can flow through the carburetor into the engine by limiting the effective intake cross section. However, this quantity of flow of the air is not directly dependent in accordance with a predetermined law on the electric variable supplied by the difference amplifier which acts on the servomotor. In order to counteract the influences of disturbing variables on the movement of the valve element therefore feedback of the position of the valve element is provided in connection with the known valve system. By means of a feedback system there is possible in this case a comparison with the signal which is given off by the difference amplifier and corresponds to the difference in speed, so as in this way to act on the servomotor in such a manner that the valve element, despite the disturbing variables, is set to a position at which the difference between actual speed and desired speed becomes zero.

In this known valve system with feedback, however—aside from the relatively sluggish adjustment of the valve element by a servomotor—the expenditure for the feedback elements is disadvantageous. This expenditure consists in particular in the additional transmitters for the feedback such as throttle-valve switch, vacuum switch or temperature switch.

The present invention therefore has the object of so developing a valve system for regulating idling speed that, with a manner of operation of the valve system which is as free of inertia as possible, a feedback of the position of the valve element is not necessary in order to adjust the amount of air required in order to obtain the desired idling speed. This valve system is therefore to be able to get along without expensive control equipment with feedback and at the same time itself be as inexpensive as possible. Furthermore, reliable disturbance-free operation of the valve system under the most different operating conditions of the engine is to be obtained.

This object is aided in accordance with the invention in the manner that the valve element (3, 21) is mounted substantially free of friction and that means are provided (for instance, passage openings 17 in FIG. 1, diaphragm membrane 26 in FIG. 2) in order to exert on the valve element a compensating force ($P_K$) which opposes the force ($P_u$) caused by the suction vacuum.

This advantageous solution is based on the discovery that a feedback of the valve element can be omitted if the valve element is mounted without friction and if measures are taken to eliminate the effect of a variable vacuum due to the suction vacuum on the position of the valve element. Due to the fact that the existing disturbance variables are eliminated by the construction of the valve system, the settings of the valve element for the freeing of the effective suction cross section necessary to obtain the desired idling speed is obtained in accordance with the difference between actual idling speed and desired idling speed, without feedback of the position of the valve element and corresponding influence of its electric drive member. In this way therefore a feedback circuit with the components present therein and particularly additional transmitters can be dispensed with.

In accordance with a first advantageous embodiment of the invention, the valve element is developed as piston (3) which can be displaced in a cylinder (2) by a solenoid (13) against the force of a spring (15). The cylinder (2) has lateral ports (5, 30) which are in communication with the outlet side (8) and can be opened or closed to a greater or lesser extent relative an inlet side (7) on the cylinder by the piston skirt (4). Furthermore the piston is mounted with a gland packing (on the piston skirt 4) in the cylinder (2) and has passage openings (17) which connect the inlet-side space in front of the end of the piston with a closed space (16) lying on the rear side of the piston.

By this development of the valve system the result is obtained that the piston, which represents the valve element, assumes a position which is dependent, in accordance with a predetermined law, on the current fed to the solenoid. The piston controls the amount of air which flows per unit of time through the carburetor into the Otto engine in the manner that it opens or closes the lateral ports in the cylinder to a greater or lesser extent corresponding to its position as determined by the solenoid. Thus the current fed to the solenoid corresponds to a given effective opening for the passage of air. Frictional influences can have practically no effect on the position of the piston since the piston is mounted with a gland packing in the cylinder. In particular, however, it is seen to it in a specially suitable manner that pressure variations which act on one side of the piston, namely on the end side which is directed towards the lateral ports, can have practically no influence on the position of the piston in the cylinder. The influence of the vacuum on the piston is elminated by the fact that the piston has passage openings which connect the inlet-side space in front of the end of the piston with a closed space lying on the rear side of the piston. Through these passage openings there threfore takes place an equalization of pressure in the manner that the resulting forces which act on the piston due to the vacuum counteract each other. In view of this advantageous valve system which operates without any substantial influence by disturbing variables the structural expense required for it is slight.

In order to obtain an idling speed which is suitable for engine operation even in case of possible failure of the solenoid, the lateral ports (5, 30) are so arranged, in accordance with a further concept of the invention, in two planes arranged one behind each other spaced apart in the direction of movement of the piston (3) that when the solenoid (13) is deenergized the ports (30) lying in the first plane are opened and those lying in the second plane are closed and that when the solenoid (13) is energized in any position of the piston (3) the ports (30) lying in the first plane are closed and those lying in the second plane are opened by excitation. In case of failure of the solenoid the piston is in this case brought by the spring into a position in which the ports in the first plane are released and thus a given amount of air necessary to maintain the idling speed, can flow through the valve. When the solenoid is energized, these ports are closed in every position of regulation of the piston and only the other ports in the second plane are active or operative.

It has been found advisable to make the passage cross section of the ports (30) lying in the first plane about half as large as the maximum passage cross section of the ports (5) lying in the second plane.

In one advantageous further development it is contemplated that in the closed space (16) of the cylinder there be arranged a solenoid (13) which is mechanically connected with the piston (3) by a connecting rod or push rod (14). In this way, while maintaining the advantageous properties described above for the reaction-free manner of operation of the valve system a particularly compact construction is obtained.

Specifically, for the low-friction mounting of the piston in the cylinder it is provided that the gland packing (on the piston skirt 4) leave free an annular opening of 2/10 mm between the cylinder and the piston.

In accordance with a second advantageous embodiment of the invention, the valve element (disk 21) is arranged between an inlet side and an outlet side in the valve housing (18) and an approximately closed space (27) which is closed off from the suction side (connection 20) by a membrane (26) which lies opposite the valve element is arranged in the valve housing, the membrane (26) and the valve element (disk 21) having equal-size surfaces which produce force from the suction pressure, and the membrane and the valve element are connected with a piston rod (22) which extends out of a solenoid in such a manner that the force $P_U$) caused by the valve element and the compensatory force $P_K$) of the membrane are equal and opposite on the push rod.

This arrangement has the additional advantages over the first solution that the cost of manufacture can be kept even less since practically no tolerances need be observed for the mounting of the valve element, which in this case can be developed as a simple round plate, and that the manner of operation of this valve system is also not disturbed by small amounts of dirt in the region of the valve element. The influence of the vacuum on the valve element, which has the result that the valve element can be opened further by the vacuum, is eliminted in the manner that an influence opposing the vacuum is exerted on the membrane so that the forces acting on the valve element and on the membrane via the push rod counteract each other. In this way and as a result of the substantially frictionless support of the valve element with the push rod, the opening path which is traversed by the valve element in order to release an effective suction cross section corresponds, in accordance with a predetermined law and free of disturbing variables, to the current which acts on the solenoid.

A particularly accurate adjustment of the valve element under different pressure conditions is obtained without feedback in the manner that the closed space (27) which lies on the side of the membrane (26) facing away from the suction side is connected with the inlet side via a gas-conducting connection (28).

In this way the result is obtained that the sides of the membrane and of the disk-shaped valve element—both arranged on the push rod—which face away from each other are acted on by the same pressure. Since the facing sides of the membrane and the valve element are acted on with the same pressure on the suction side, the force acting on the entire system at the push rod is zero when the effective membrane surface is dimensioned equal to the effective valve surface.

In a further development of the second embodiment it is provided that the membrane (26) be developed at least in part elastically and that the solenoid (23) be arranged in the closed space (27). In this way there is obtained a compact arrangement with only few individual parts, which is particularly well-suited for low-cost manufacture and permits a high reliability in operation.

In order to obtain the most favorable consumption and emission values it is desirable to adjust the idling speed of the engine to the lowest possible value, for instance, in the case of an eight-cylinder engine, to 500 rpm. Such an idling speed, however, is so close to the engine operating limit that in the event of a sudden even slight additional load on the engine the latter dies. This disadvantage of a brief dynamic reduction in speed can, in accordance with a further idea of the invention, be circumvented in the case of a circuit having a difference amplifier whose one input is acted on by an electric value corresponding to the desired idling speed and whose other input is operatively connected with a rpm transducer, in the manner that the rpm transducer (35) is connected with the difference amplifier (32) via a differential amplifier (31) whose differential part can be switched to active upon a reduction in speed and to inactive upon an increase of speed. By the interposition of such a differential amplifier between the transducer and difference amplifier the differential portion can be selected so high that in case of a drop in speed a rapid, sufficiently strong smoothing out of the change in speed takes place without the control circuit becoming unstable. The latter would namely occur if only a normal differential amplifier with a high differential portion were used. If this differential portion were then selected smaller in order to obtain a stable control circuit, an insufficient counteracting of a reduction in speed would on the one hand result and additional vacuum switches and valves would be necessary in order to again eliminate this inadequate control. The use of a differential amplifier with a differential portion which is active only upon a reduction in speed circumvents this entire problem at extremely little structural expense.

In one preferred embodiment, the differential amplifier (31) comprises a difference amplifier (34) whose output is connected via an ohmic voltage divider (36) which lies capacitively on a fixed reference potential to its one input and in the manner that parallel to the resistance of the voltage divider (36) which is connected to the output of the difference amplifier (34) there lie the inputs of a difference amplifier (38) which has a diode feedback. Such an embodiment requires a particularly low expenditure for parts.

With the above and other objects and advantages in view, the present invention will become more clearly understood in connection with the detailed description of preferred embodiments, when considered with the accompanying drawings, of which:

Figure 1:
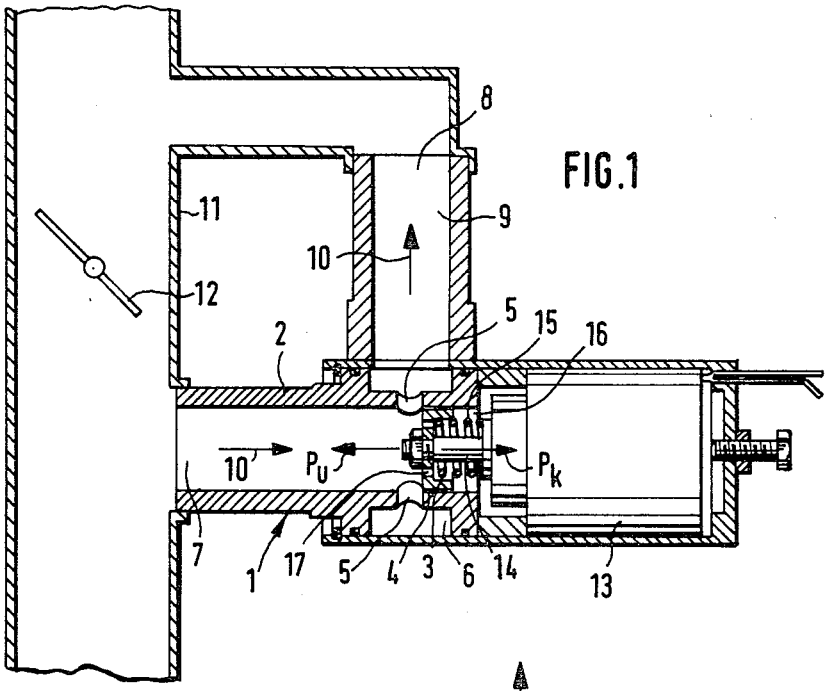
FIG. 1 is a first embodiment of a valve system, seen in longitudinal section.

In FIG. 1, a valve housing 1 has a cylinder 2. A piston 3 is displaceable within the cylinder. The piston is so fitted in the cylinder that it forms a gland "seal" with an annular free opening of about 2/10 mm between its piston skirt and the inside of the cylinder, the piston skirt meaning its outer cylindrical surface.

In the region of movement of the piston skirt 4 there are present in the cylinder lateral ports 5 which can be covered to a greater or lesser extent by the piston skirt. The ports discharge into an annular channel 6.

Through the housing with the cylinder there is formed a gas path for a flow of air from an inlet side 7 via the lateral ports 5 and the annular channel 6 to the suction side 8 at the connection 9. The air flow is in this connection indicated by the arrows 10. The cylinder 2 and the connection 9 are connected with a suction conduit 11 having a throttle valve 12.

For the displacement of the piston there is provided a solenoid 13 which is arranged in the housing 1 and is connected via a push rod 14 with the piston. The piston in this connection rests against a spring 15.

The piston incompletely closes the inlet side off from a closed space 16 which lies at its rear. The closed space is air-tight, except in the region of the piston 3. The piston, however, permits air to flow—aside from the gland packing on its piston jacket 4—through passage openings 17. In this way there is produced in the closed space 16 practically the same vacuum as on the inlet side in the cylinder. Accordingly the force $P_U$ which is caused by the vacuum acts on the piston 3 and an oppositely directly compensating force $P_K$ acts on its rear side. The position of the piston thus does not depend on the pressure conditions in the cylinder. Rather, since frictional influences play practially no role as a result of the gland packing, the piston is pushed by the push rod 14 into a position which corresponds to the current fed to the solenoid 13. In this way by establishing the current the effective inlet cross section which is produced by the covering of the lateral ports 5 by the piston skirt can be accurately adjusted.

Figure 2:
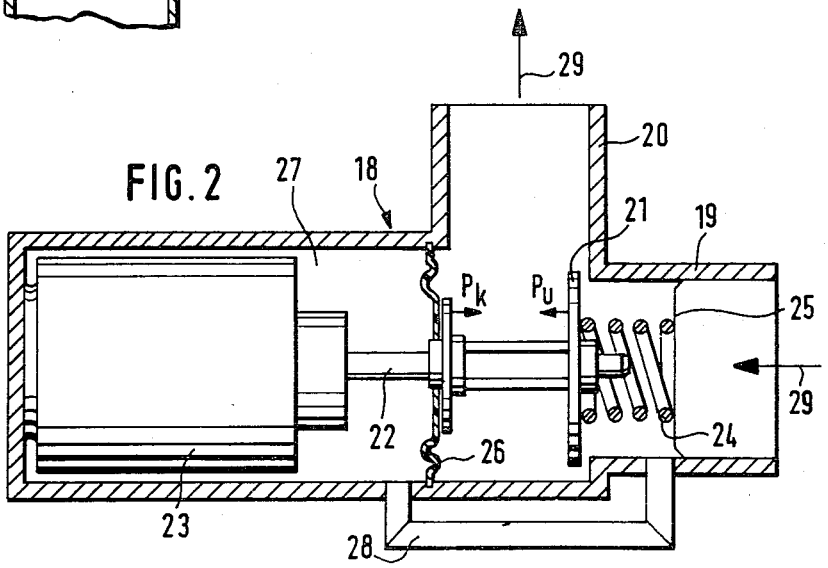
FIG. 2 is a second embodiment of a valve system, seen in longitudinal section.

In FIG. 2, a valve housing 18 has a first connection 19 on the intake side and a second connection 20, perpendicular thereto, on the suction side. The connection 19 can be closed off to a greater or lesser extent from the connection 20 by a flat round disk 21 which acts as the valve element. This disk 21 thus determines the effective suction cross section. For this purpose, the disk 21 is displaceable via a push rod 22 by a solenoid 23 in opposition to the force of a spring 24 which rests against a spider 25 pressed into the connection 19.

At a distance from the disk 21 there is fastened on the push rod a membrane diaphragm 26 which closes the connection 20 off on the suction side from an approximately closed space 27. The approximately closed space is in communication via a gas-conducting connection 28 with the connection 19 on the inlet side.

The membrane is developed in such a manner that it has a surface which is in effect equal in size to that of the flat disk 21 and on which pressures in the closed space and on the suction side can act in order to produce a compensatory force $P_k$ which corresponds to the vacuum $P_U$ produced by the vacuum on the disk 21.

In this way, in the embodiment of FIG. 2 the influence of the vacuum on the position of the disk 21 which acts as valve element is also eliminated. The valve element is supported with the push rod 22 in a substantially frictionless manner since the frictional influences can be neglected as a result of the development of the membrane 26. The valve system shown in FIG. 2 therefore gives a flow of the air drawn in by the Otto engine in the direction indicated by the arrows 29, which air, even without feedback exactly corresponds in accordance with a predetermined law to the current fed to the solenoid 23.

Figure 3:
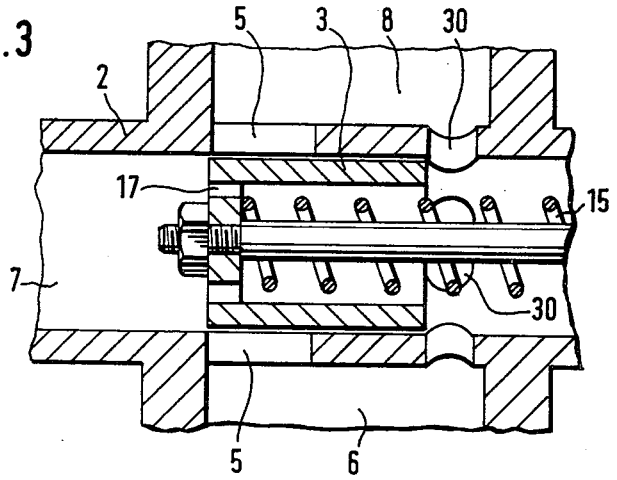
FIG. 3 is a modification of the first embodiment of the valve system of FIG. 1.

In the case of the modification of the valve arrangement shown on a larger scale in FIG. 3, further ports 30 which are opened in the position of rest of the piston 3 are provided in the cylinder 2 of the valve housing 1 in the direction of movement of the piston 3 alongside of the lateral ports 5. The air flow can pass then, in the position of rest of the piston 3, through the passage opening 17 in the piston and the ports 30 from the inlet side 7 to the suction side 8. In this way assurance is provided that an idling speed can establish itself even in case of the failure of the solenoid 13. As soon as the electrical system of the automobile has been connected via the ignition key, the piston 3 moves, against the action of the spring 15, into a position in which the ports 30 are closed by the rear portion of the piston. Upon this movement the ports 5 are also released for a given flow cross section amount via the front portion of the piston, said amount being in general somewhat smaller than that of the ports 30.

Figure 4:
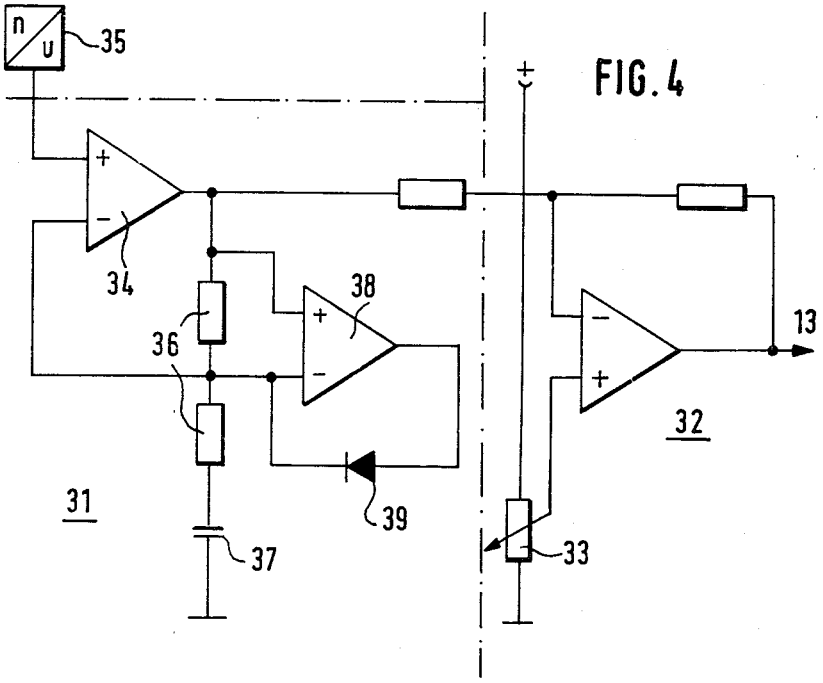
FIG. 4 is a simplified circuit for the control of the setting member as a function of speed.

The circuit provided for the control of the solenoid 13 as a function of the speed is shown in FIG. 4, in which merely the essential details of the circuit have been shown. The circuit consists essentially of a differential amplifier 31 whose output is connected with the negative input of a difference amplifier 32. The positive input of the difference amplifier 32 is acted on by a voltage which corresponds to the desired idling speed and which can be adjusted in a manner specific to the engine via a variable resistor 33. The solenoid 13 is located in the output of the difference amplifier 32.

The differential amplifier 31 contains a difference amplifier 34 whose one input is connected with a tachometer 35 which gives off a voltage which is proportional to the instantaneous engine speed. The other input of the difference amplifier 34 is connected to a voltage divider 36 which is connected at one end to the output of the difference amplifier 34 and at the other end, via a capacitor 37 to a fixed reference voltage potential, namely ground. In parallel to the resistor of the voltage divider which is adjacent the difference amplifier 34 there are located the two inputs of another difference amplifier 38 whose output is connected, via a diode 39, with the junction point of the two voltage divider resistors. In this way the result is obtained that the differential portion determined by the voltage divider 36 and the capacitor 37 only becomes effective when a drop in potential occurs in the output of the difference amplifier 34. In such a case, the resistor of the voltage divider 36 which is adjacent the difference amplifier 34 is fully active since no current, or only a negligible current can flow over the branch containing the difference amplifier 38 and the diode 39. If an increase in potential, however, occurs in the output of the difference amplifier 34 then a flow of current is produced over the difference-amplifier/diode branch, which leads to a considerable reduction in the action of the differential portion. While we have disclosed several embodiments of the invention it is to be understood that these embodiments are given by example only and not in a limiting sense.

The term "gland packing" in the specification is commonly called "controlled gap seal".

We claim:

1. In a valve arrangement system for regulating the idling speed of Otto engines, particularly automobile engines, by controlling the amount of air on an outlet side having suction vacuum with an electromechanical setting member which comprises a valve element which limits an effective outlet cross section, the valve element being moveable by an electric drive member and being in communication on one side with the outlet side, and having a circuit which operatively controls the setting member as a function of the speed of rotation, the improvement wherein the valve element is mounted substantially free of friction, compensation means for exerting on the valve element a compensating force which opposes the force caused by the suction vacuum, an rpm transducer providing a variable signal dependent on the actual rotational speed of the engine, said circuit includes, a first difference amplifier having one input acted on by an electric value corresponding to the desired idling speed and another input operatively connected to said rpm transducer, said first difference amplifier having an output connected to said electric drive member, a differential amplifier means for connecting said rpm transducer to said first difference amplifier and having a differential portion which is switchable to effectiveness upon a reduction in the speed and to inactive upon an increase of the speed.

2. The valve arrangement system as set forth in claim 1, wherein said differential amplifier means comprises, a second difference amplifier, an ohmic voltage divider connected at one end to an output of said second difference amplifier, a capacitor is connected to another end of said voltage divider and to a fixed reference potential, respectively, one input of said second difference amplifier is connected to a divided voltage point of said voltage divider, said rpm transducer is connected to another input of said second difference amplifier, said voltage divider has a resistor disposed between said divided voltage point and said one end connected to said output of said second difference amplifier, a third difference amplifier has inputs connected in parallel to said resistor, a diode feedback connected from an output of said third difference amplifier to said divided voltage point of said voltage divider, said output of said second difference amplifier is connected to said another input of said first difference amplifier.

3. The valve arrangement system as set forth in claim 1, further comprising a cylinder communicates with an inlet side and is formed with lateral ports which are in communication with the outlet side, said valve element is formed as a piston displaceably mounted in said cylinder and having a piston skirt moveable in the range of said ports, spring means for biasing said piston, the electric drive member includes a solenoid means for displacing said piston against the biasing of said spring means for opening and closing said ports to a greater and lesser extent respectively with respect to the inlet side by the piston skirt, a gland packing disposed on said piston skirt in said cylinder, said piston is formed with an end wall having passage openings, constituing said compensation means, communicating an inlet side region of said cylinder in front of the end wall of the piston with a substantially closed space defined at a rear side of the piston in said cylinder, and said lateral ports are arranged in two cross-sectional planes in said cylinder disposed spaced apart one behind each other in a direction of movement of said piston such that when said solenoid means is deenergized said ports which are disposed in a first of said planes are opened and said ports which are disposed in the second of said planes are closed, and when said solenoid means is energized in every position of said piston said ports which are disposed in said first plane are closed and said ports which are disposed in said second plane are opened according to the excitation.

4. The valve arrangement system as set forth in claim 3, wherein the flow-through cross-section of said ports which are disposed in the first plane is about half as large as the maximum flow-through cross-section of said ports which are disposed in the second plane.

5. The valve arrangement system as set forth in claim 3, wherein said solenoid means is arranged in said closed space of said cylinder, a push rod means is mechanically connected to said solenoid means and said piston.

6. The valve arrangement system as set forth in claim 3, wherein said gland packing on said piston skirt constitutes means for leaving free an annular opening of approximately 2/10 mm between said cylinder and said piston.

7. The valve arrangement system as set forth in claim 1, further comprising a valve housing, said valve element constitutes a disc arranged between an inlet side and the outlet side operatively mounted in said valve housing, a membrane constituting said compensation means is disposed in said valve housing and closes off a closed space therein from the outlet side having suction vacuum, said membrane is disposed opposite said valve element, said membrane and said disc have equal-size surfaces each constituting means for building-up force from the suction pressure of said outlet side, the electric drive member includes a solenoid, a piston rod operatively extends from said solenoid, said membrane and said disc are connected to said piston rod such that the force built up on said disc and the force built up on said membrane, constituting the compensating force, on said push rod are equal and opposite.

8. The valve arrangement system as set forth in claim 7, further comprising a gas-conducting conduit connects said closed space on a side of said membrane facing away from a suction vacuum side with said inlet side.

9. The valve arrangement system as set forth in claim 7, wherein said membrane at least in part is formed elastically, and said solenoid is arranged in said closed space.

* * * * *